United States Patent [19]

Adams et al.

[11] Patent Number: 4,712,379

[45] Date of Patent: Dec. 15, 1987

[54] MANUAL RECYCLER FOR DETONATING IMPACT TOOL

[75] Inventors: Joseph S. Adams, Whistler; Paul G. Branston, Vancouver, both of Canada

[73] Assignee: Pow-R Tools Corporation, Vancouver, Canada

[21] Appl. No.: 1,622

[22] Filed: Jan. 8, 1987

[51] Int. Cl.[4] ..... F01B 29/08; F02N 13/00

[52] U.S. Cl. ..... 60/632; 60/633

[58] Field of Search ..... 60/632–638

[56] References Cited

U.S. PATENT DOCUMENTS

| | | | |
|---|---|---|---|
| 3,645,091 | 2/1972 | Ivanov et al. | 60/632 X |
| 4,218,888 | 8/1980 | Jayne | 60/632 |
| 4,282,714 | 8/1981 | Fiocchi | 60/632 |
| 4,365,471 | 12/1982 | Adams | 60/633 X |
| 4,510,748 | 4/1985 | Adams | 60/633 X |

*Primary Examiner*—Allen M. Ostrager

*Attorney, Agent, or Firm*—Stonebraker, Shepard & Stephens

[57] ABSTRACT

A detonating impact tool 10 has a manual recycler that works by manually pressing the tool and a fastener 25 against a work piece 51 to push a front housing 12 into a main housing 11 against a compression spring 30. This charges a detonation chamber 15 with a fuel and air mixture that is precompressed and detonated to drive a piston 20 and its impact rod 22 forward, driving the fastener into the work piece. On completion of its impact stroke, the piston clears an exhaust port 31, allowing exhaust gases to escape through an exhaust passageway 32. Following this, purging air rushes in through inlet 27 as the exhaust gases collapse; and as the tool is retracted from the work piece, pumping seal 26 draws purging, cooling, and recharging air into detonation chamber 15 as front housing 12 is returned to its forward position by the spring.

28 Claims, 4 Drawing Figures

MANUAL RECYCLER FOR DETONATING IMPACT TOOL

BACKGROUND

U.S. Pat. Nos. 4,365,471 and 4,510,748 of one of the co-inventors of this application disclose a detonating impact tool having a detonation chamber in which a fuel and air mixture is detonated by means of flame jets directed into the detonation chamber through a detonation plate from an ignition chamber. A pending application by the same co-inventor, Ser. No. 703,821, now U.S. Pat. No. 4,665,868, describes a way of automatically purging and recycling such a detonating impact tool.

The present invention involves a manual recycler for such a detonating impact tool. Although the manual recycler is slower than the automatic recycler, it is also simpler and less expensive, so that it can make the detonating impact tool available at a lower price for users who are not impeded by the slower recycling rate. Generally, our manual recycler achieves efficiency and effectiveness combined with simplicity and practicality in producing ample fastener driving force from a small and lightweight tool.

SUMMARY OF THE INVENTION

Our detonating impact tool includes a detonation chamber surrounded by a main or pump housing within which a front housing moves axially against a compression spring. A pumping seal works between the front housing and the main housing, and the detonation chamber contains an axially movable piston having an impact rod that extends forward of the detonation chamber and the front housing for driving fasteners. An exhaust passageway leads from the detonation chamber, in a region cleared by a head of the piston at full impact stroke, and through a forward region of the front housing. Check valving is arranged for both fuel and air intake to the detonation chamber and an outlet from the exhaust passageway. These elements are arranged so that when the front housing moves rearwardly as the tool is pressed against a work piece, the detonation chamber is charged and then detonated, driving said piston and said impact rod forward to drive a fastener into the work piece. As the head of the piston clears an exhaust port in the detonation chamber wall, exhaust gases escape from the detonation chamber through the check valved exhaust passageway in the front housing. Upon retraction of the tool from the work piece, the compression spring moves the front housing forward, drawing air into the ignition and detonation chambers and preparing the tool for another cycle.

DRAWINGS

FIGS. 1–3 are partially schematic, cross-sectional views of a preferred embodiment of our manual recycler for a detonating impact tool, showing the tool at rest in FIG. 1, pressed against a work piece in FIG. 2, and detonated to drive a fastener in FIG. 3; and FIG. 4 is a fragmentary cross-sectional view of the impact tool of FIGS. 1–3 taken along the line 4—4 of FIG. 2.

DETAILED DESCRIPTION

Figure 1:
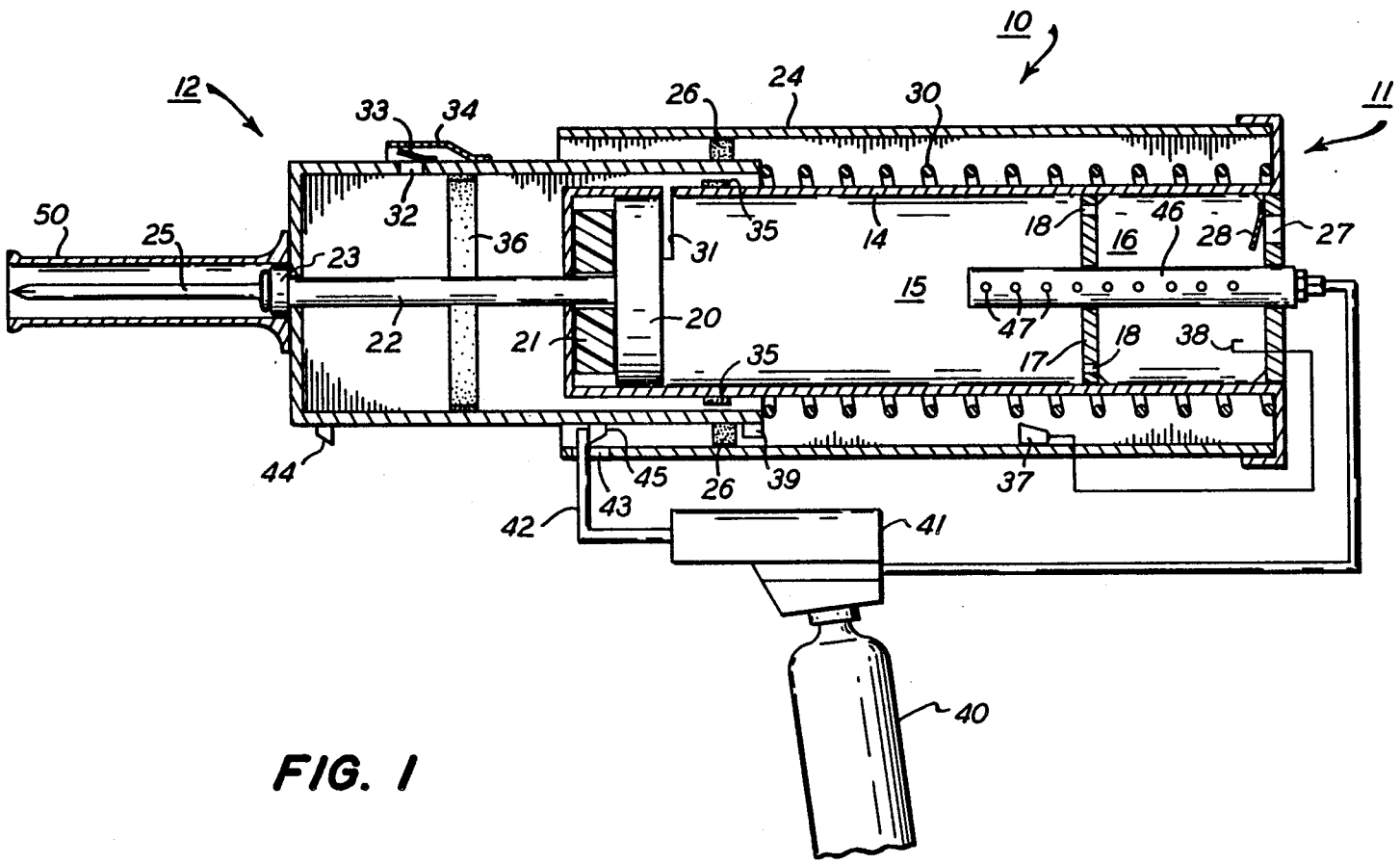

This invention involves a manual recycler for detonating impact tool 10. For simplicity, conventional parts have been eliminated, and the preferred structure is illustrated schematically in the drawings. The operation will be explained after the preferred components are described.

Detonating impact tool 10, with its manual recycler as shown in the drawings, has essentially the same power source as described in U.S. Pat. Nos. 4,365,471 and 4,510,748. This includes detonation chamber 15 and ignition chamber 16 separated by detonation plate 17 having holes 18 close to its periphery. A fuel and air mixture in both chambers is ignited in ignition chamber 16, where combustion forces flame jets through holes 18 in detonation plate 17. The flame jets extend along the cylindrical wall 14 of chamber 15 where they cause a very rapid dynamic compression and detonation. This drives piston 20 and its impact rod 22 forward on a power or impact stroke that drives fastener 25.

The preferably cylindrical wall 14 of detonation chamber 15 forms an inner wall of a main or pump housing 11 having an outer wall 24 surrounding a space around inner wall 14. A front housing 12 moves axially back and forth in the space between inner wall 14 and outer wall 24 where a compression spring 30 biases front housing 12 forward to the position shown in FIG. 1.

A pumping seal 26, arranged around the outside of front housing 12, engages and slides along the inside of outer wall 24 of pump housing 11 so that front housing 12 acts as a pumping piston within pump housing 11 as it moves back and forth. We prefer that forward housing 12 and outer wall 24 of main housing 11 be generally rectangular in cross section around preferably cylindrical inner wall 14. Pumping seal 26 is thus correspondingly rectangular.

An inlet opening 27, with a check valve 28, admits air into chambers 16 and 15. This occurs after a detonation and when forward housing 12 moves forward upon withdrawal of tool 10 from a work piece after driving a fastener.

An exhaust port, preferably formed as a slot 31 in detonation chamber wall 14, is positioned where it is cleared by the head of piston 20 reaches bumper 21 on full impact stroke. An exhaust outlet opening 32 is arranged nearby in front housing 12. Opening 32 has a check valve 33, preferably covered by a guard and limiter 34, to allow exhaust gases from port 31 to pass through opening 32 and be directed forward by check valve 33 and limiter 34.

Figure 2:
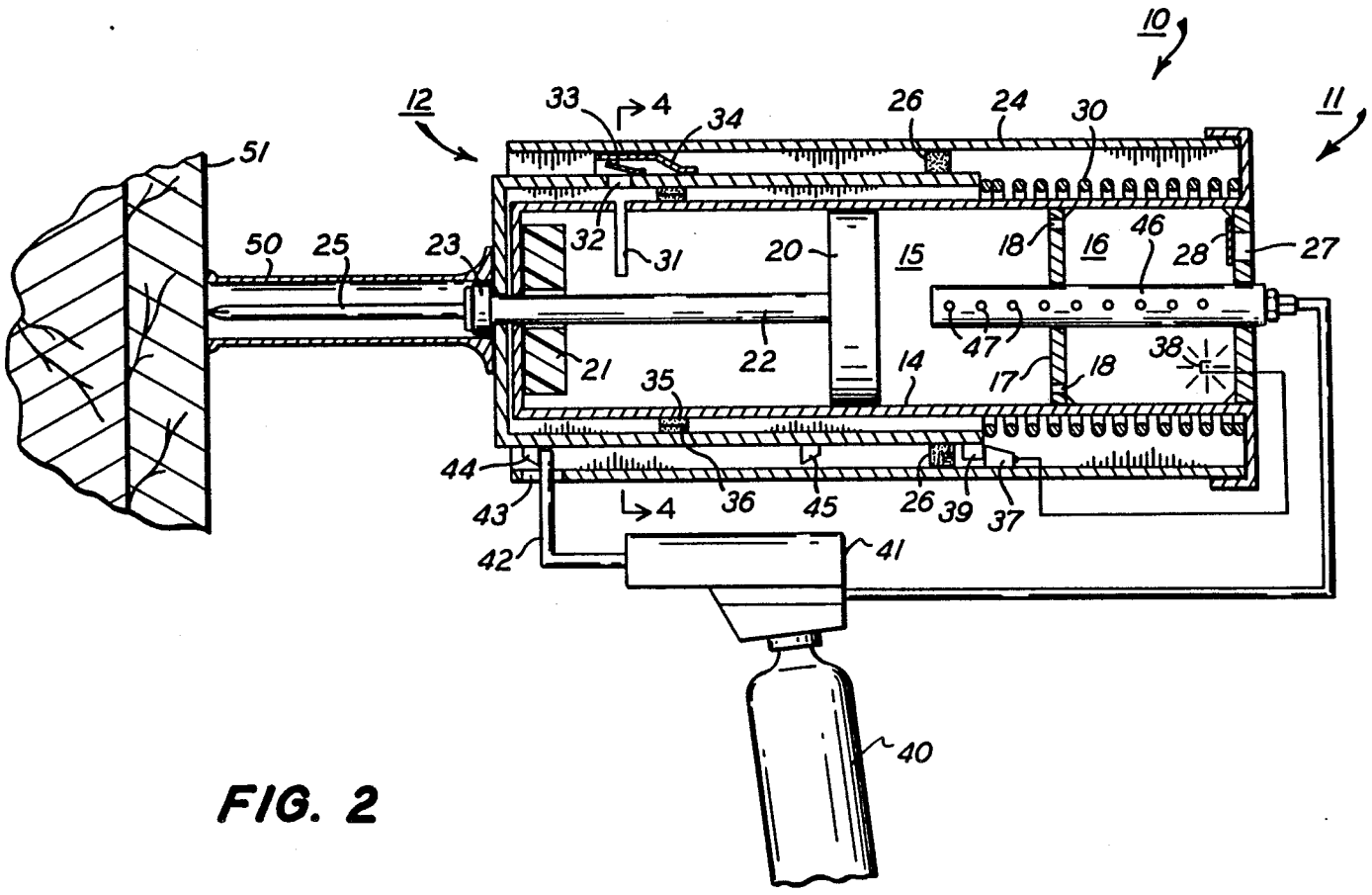
Figure 3:
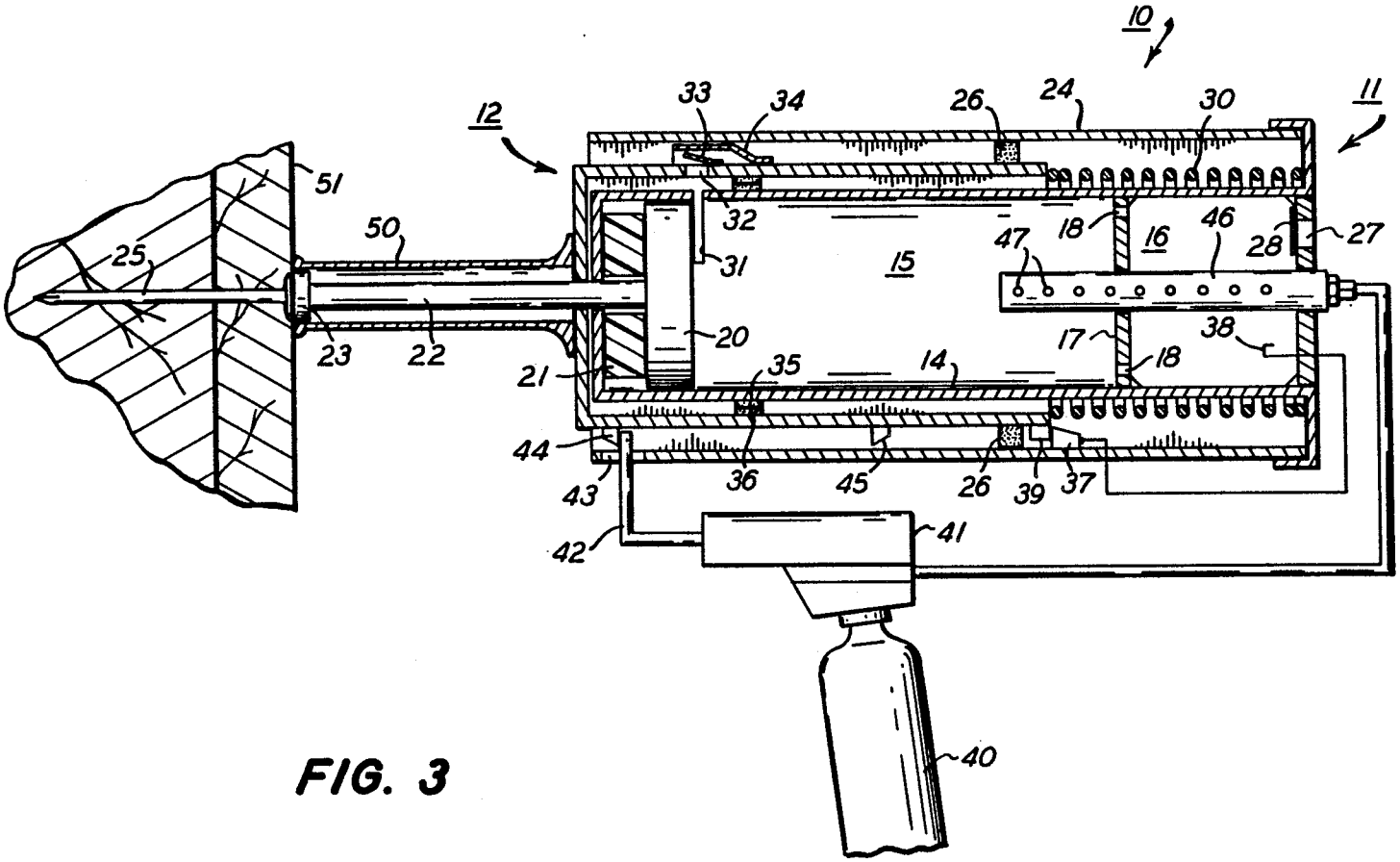
Figure 4:
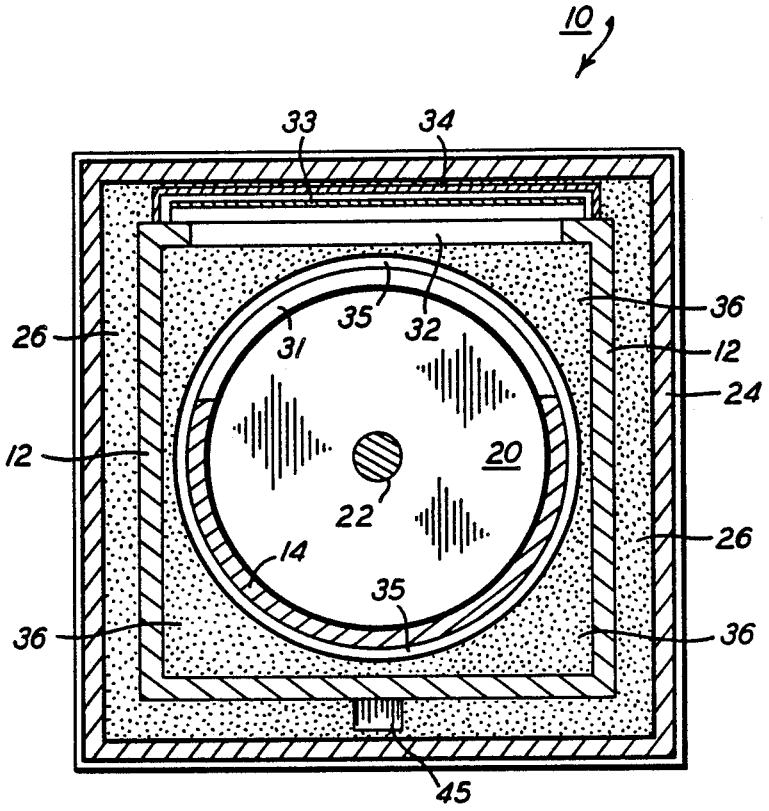

A pair of seals 35 and 36, mounted respectively on the outside of wall 14 and on the inside of front housing 12, close together to provide an exhaust seal when front housing 12 is fully retracted into main housing 11, as shown in FIGS. 2 and 3. With front housing 12 being rectangular in cross section as preferred, seal 36 is mounted in a hole in a plate 37 arranged inside of front housing 12, as shown in FIG. 4, to engage seal 35 around detonation chamber wall 14.

A lug 39 on front housing 12 is positioned to engage an ignition device 37, preferably in the form of a piezoelectric crystal, on full retraction of front housing 12. Ignition device 37 provides a spark to spark plug 38 for igniting a charge in ignition chamber 16.

A fuel system, similar to the one disclosed in U.S. Pat. No. 4,365,471, includes a fuel supply 40, a fuel valve 41, and a fuel valve actuator 42 movable in a slot 43 in outer wall 24 by lugs 44 and 45 on front housing 12 as front housing 12 moves in and out. A fuel charge, metered by valve 41, is admitted to chambers 15 and 16 via a pipe 46 having perforations 47.

An impact head 23 of impact rod 22 seats against a fastener 25 held in guide 50 extending forwardly of front housing 12. A magazine or supply of fasteners feeds one fastener at a time into guide 50 to seat against impact head 23. A variety of nails and staples can be used with detonating impact tool 10, and many different magazines and fastener feeders are available to supply the fasteners one at a time to be driven into work piece 51.

Many variations on the illustrated embodiment are also possible, including different fuel injectors, ignition systems, chamber shapes, and valving and sealing arrangements. Whatever specific configurations are chosen, we prefer that they operate as follows.

In a relaxed or non-working position as shown in FIG. 1, front housing 12 of tool 10 is fully forward under the bias of spring 30 with the head of piston 20 against bumper 21 and the impact head 23 of rod 22 limiting further forward movement of housing 12. A fastener 25, positioned in guide 50, is seated against impact head 23 and ready for driving.

To accomplish this, the user presses fastener 25 and guide 50 against work piece 51 in the location where fastener 25 is to be driven. This pushes front housing 12 into main housing 11 while compressing spring 30 and causing several events to occur.

Lug 45 moves away from fuel valve actuator 42 so that fuel valve 41 releases a metered amount of fuel vapor, which is stored at a pressure somewhat above atmospheric, so that the fuel charge passes into pipe 46 and out through apertures 47 into the air present in chambers 15 and 16. Meanwhile, check valve 33 opens over exhaust outlet 32 to let excess air escape from front housing 12, and check valve 28 closes over inlet 27, trapping the air within chambers 15 and 16. Piston head 20 moves rearwardly with front housing 12, fastener 25, and guide 50, compressing the fuel and air mixture in chambers 15 and 16.

When front housing 12 is fully retracted, to the position shown in FIG. 2, exhaust seals 35 and 36 engage each other to seal against any back flow of exhaust, lug 44 moves actuator 42 to close fuel valve 41, and lug 39 engages ignition device 37, sending a spark to spark plug 38. This ignites the charge in ignition chamber 16, where the combustion injects flame jets through holes 18 in detonation plate 17. The flame jets shoot along wall 14 of detonation chamber 15 where they cause a dynamic compression and detonation that quickly and cleanly burns the compressed fuel and air mixture.

This drives piston 20 rapidly forward, advancing impact rod 22 so that its head 23 drives fastener 25 into work piece 51, as shown in FIG. 3. Air in detonation chamber 15 ahead of piston 20 exhausts through port 31 and passageway 32 as piston 20 advances on its power stroke. When the head of piston 20 reaches and covers slot 31, this outlet is closed; but at this point, fastener 25 is nearly driven and the head of piston 20 has nearly reached bumper 21.

At the completion of the power or impact stroke, impact head 23 drives fastener 25 fully home into work piece 51 as the head of piston 20 bangs against bumper 21. In this position, as shown in FIG. 3, the head of piston 20 clears and opens exhaust port 31, allowing exhaust gases to escape through port 31, through exhaust passageway 32, and past check valve 33, which directs the hot gases forward from main housing 11. The engagement of seals 35 and 36 prevents any escape of exhaust gases rearwardly where they would heat parts of the tool. Quickly after the outrush of exhaust gases, the pressure within chamber 15 collapses, causing a vacuum that closes exhaust check valve 33, opens check valve 28, and draws purging air in through inlet 27. Shortly thereafter the user removes tool 10 from work piece 51, having completed the driving of fastener 25. This lets spring 30 push front housing 12 forward toward the position of FIG. 1. As this occurs, exhaust check valve 33 remains closed, intake check valve 28 remains open, and pumping seal 26 moves along pump housing 11. This draws purging, cooling, and recharging air into ignition chamber 16, detonation chamber 15, and into the enlarging space within front housing 12. This also loads another fastener 25 into guide 50 and readies tool 10 for another cycle, which can be actuated by again pressing the tool against a work piece.

The manual effort of pressing tool 10 against a work piece accomplishes some of the recycling functions and contributes some precompression to the fuel and air mixture, to increase the available power. The manual movement also slows down the recycling speed somewhat, because tool 10 cannot be operated faster than a workman can press it successively against a work piece. This speed is adequate for many purposes, however, and using a manual component in the recycling system helps make tool 10 simple, effective, inexpensive, and powerful for its weight.

We claim:

1. A detonating impact tool comprising:

a. a main housing having spaced inner and outer walls, with an inner wall enclosing a detonation chamber and an outer wall surrounding a space around said inner wall;

b. a front housing fitting between said inner and outer walls where a compression spring biases said front housing forward;

c. a piston axially movable within said detonation chamber and having an impact rod extending forward of said detonation chamber and said front housing;

d. an exhaust passageway for exhausting gases from said detonation chamber out through said front housing;

e. means for admitting air and fuel to said detonation chamber; and f. said front housing, piston, and main housing being arranged so that pressing a fastener against a work piece with said tool to retract said piston and said front housing against said spring charges and then detonates a charge in said detonation chamber, driving said piston and said impact rod forward to drive said fastener into said work piece, and opening said exhaust passageway to initiate an exhaust.

2. The tool of claim 1 wherein forward movement of said front housing upon retraction of said tool from said work piece draws purging and recharging air into said detonation chamber.

3. The tool of claim 1 wherein said exhaust passageway includes a port through said inner wall in a region cleared by a head of said piston at the end of its impact stroke so that exhaust gases can pass through said port and into a forward region of said front housing.

4. The tool of claim 3 wherein said exhaust passageway includes a check valve over an exhaust outlet from said forward region of said front housing.

5. The tool of claim 4 wherein forward movement of said front housing upon retraction of said tool from said work piece draws purging and recharging air into said detonation chamber.

6. The tool of claim 3 including a seal closed in a retracted position of said front housing between said front housing and said inner wall rearwardly of said exhaust port.

7. The tool of claim 6 where, in cross section, said inner wall is cylindrical and said outer wall and said front housing are generally rectangular.

8. The tool of claim 1 including a pumping seal between said front housing and said outer wall of said main housing.

9. The tool of claim 8 including a check valved air intake into said detonation chamber and a check valve over an outlet of said exhaust passageway so that when said front housing moves forward in response to said compression spring upon retraction of said tool from said work piece, air is drawn into said detonation chamber through said intake.

10. The tool of claim 9 including a seal closed between said front housing and said inner wall of said main housing rearwardly of said exhaust passageway when said front housing is fully retracted against said spring.

11. The tool of claim 10 wherein said exhaust passageway includes a port through said inner wall of said main housing.

12. The tool of claim 11 where, in cross section, said inner wall is cylindrical and said outer wall and said front housing are generally rectangular.

13. A detonating impact tool comprising:

a. a single walled front housing movable rearwardly against a compression spring in a space between double walls of a main housing having an inner wall enclosing a detonation chamber;

b. a piston movable within said detonation chamber and having an impact rod extending forward of said front housing;

c. a pumping seal between said front housing and an outer wall of said main housing;

d. an exhaust seal between said front housing and said inner wall of said main housing arranged for sealing closed when said front housing is fully retracted into said space;

e. an exhaust passageway extending through a forward region of said front housing; and f. an exhaust port arranged in said inner wall forward of said exhaust seal to open into said exhaust passageway in a region cleared by said piston upon completion of a power stroke, so that said exhaust port, when open, admits gases from said detonation chamber into said exhaust passageway.

14. The tool of claim 13 including check valving for an outlet of said exhaust passageway.

15. The tool of claim 14 including a check valved intake for admitting air to said detonation chamber following exhaust.

16. The tool of claim 15 wherein forward movement of said front housing in response to retraction of said tool from a work piece draws air through said intake into said detonation chamber.

17. The tool of claim 13 including means responsive to rearward movement of said front housing as said tool is pressed against a work piece for first charging and then detonating a charge in said detonation chamber, driving said piston and said impact rod forward to drive a fastener into said work piece.

18. The tool of claim 17 including check valving for an outlet of said exhaust passageway, a check valved intake for admitting air to said detonation chamber following exhaust, and wherein forward movement of said front housing in response to retraction of said tool from said work piece draws air through said intake into said detonation chamber.

19. The tool of claim 13 wherein air within said detonation chamber ahead of said piston passes through said exhaust port and into said exhaust passageway as said piston approaohes said exhaust port on said power stroke.

20. The tool of claim 13 where, in cross section, said inner wall is cylindrical, and said outer wall and said front housing are generally rectangular.

21. A detonating impact tool comprising:

a. a detonation chamber having an axially movable piston with a forwardly extending impact rod;

b. a pump housing surrounding a space around said detonation chamber;

c. a front housing axially movable in said space between said detonation chamber and said pump housing where a compression spring biases said front housing forward;

d. a pump seal between said front housing and said pump housing;

e. an exhaust passageway leading from said detonation chamber, in a region cleared by a head of said piston at full impact stroke, and through a forward region of said front housing;

f. a check valved intake to said detonation chamber; and g. check valving over an outlet of said exhaust passageway.

22. The tool of claim 21 including an exhaust seal between said front housing and said detonation chamber rearwardly of said exhaust passageway and arranged for sealing closed when said front housing is fully retracted into said space.

23. The tool of claim 21 wherein said check valving for said exhaust passageway outlet is arranged on an outer surface of said front housing.

24. The tool of claim 21 including means responsive to rearward movement of said front housing as said tool is pressed against a work piece for first charging and then detonating a charge in said detonation chamber for driving said piston and said impact rod forward to drive a fastener into said work piece.

25. The tool of claim 24 including an exhaust seal between said front housing and said detonation chamber rearwardly of said exhaust passageway and arranged for sealing closed when said front housing is fully retracted into said space.

26. The tool of claim 24 wherein forward movement of said front housing in response to said spring, upon retraction of said tool from said work piece, draws air into said detonation chamber.

27. The tool of claim 21 wherein air within said detonation chamber ahead of said piston passes through said exhaust port and into said exhaust passageway as said piston approaches said exhaust port on said impact stroke.

28. The tool of claim 21 where, in cross section, said pumping housing and said front housing are generally rectangular.

* * * * *